United States Patent [19]

Hellman

[11] 4,241,903

[45] Dec. 30, 1980

[54] APPARATUS FOR HEAT TREATING ELONGATED SHEETS

[75] Inventor: Erik R. Hellman, Vesterås, Sweden

[73] Assignee: AB Asea-Atom, Vesterås, Sweden

[21] Appl. No.: 66,975

[22] Filed: Aug. 16, 1979

[30] Foreign Application Priority Data

Aug. 22, 1978 [SE] Sweden ..... 7808831

[51] Int. Cl.[3] ..... C21D 9/52

[52] U.S. Cl. ..... 266/109

[58] Field of Search ..... 266/109

[56] References Cited

U.S. PATENT DOCUMENTS

| | | | |
|---|---|---|---|
| 2,293,873 | 8/1942 | Wirt | 266/109 |
| 2,529,690 | 11/1950 | Hess | 266/109 |
| 2,806,130 | 9/1957 | Gray | 266/109 |

*Primary Examiner*—P. D. Rosenberg

*Attorney, Agent, or Firm*—Pollock, Vande Sande & Priddy

[57] ABSTRACT

An apparatus is disclosed for heat treating metal sheet, comprising water-cooled cooling rolls (VII', VII''), a transportation channel (17) filled with protective gas, and a heating coil chamber (19) for a high-frequency coil (20,21).

8 Claims, 8 Drawing Figures

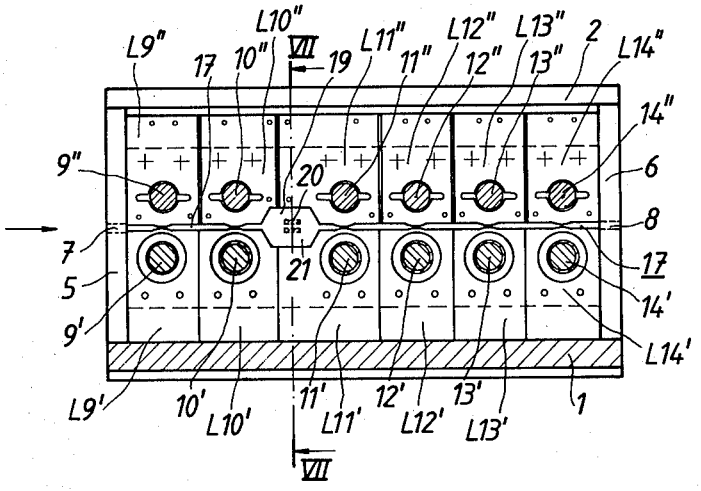
FIG.3
FIG.5
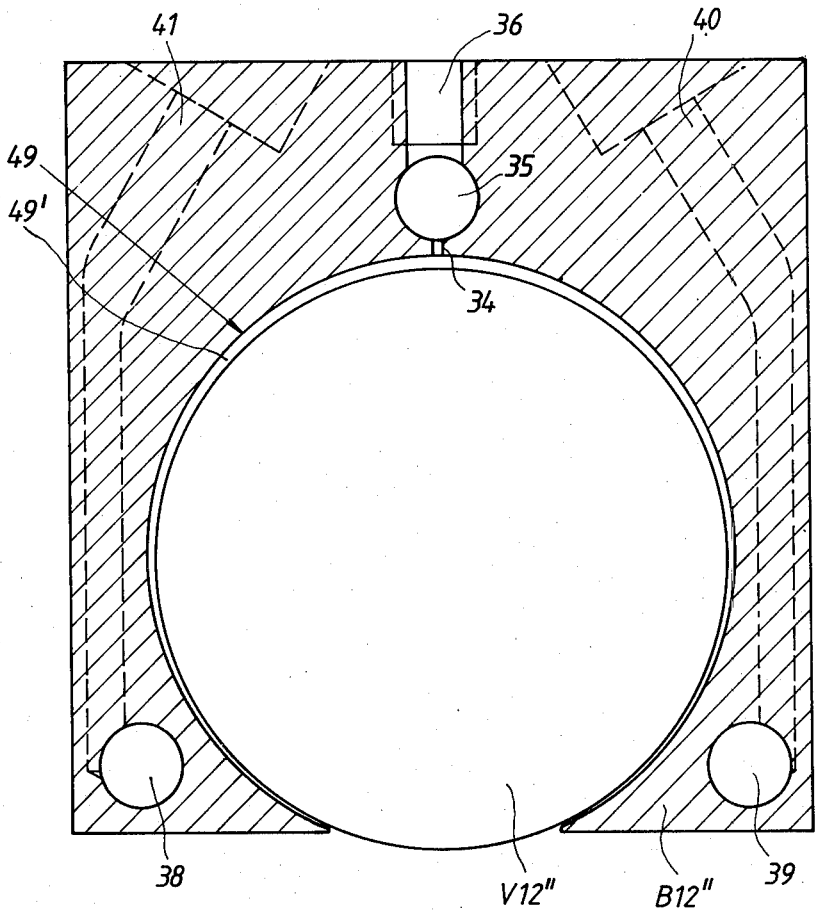

APPARATUS FOR HEAT TREATING ELONGATED SHEETS

TECHNICAL FIELD

The present invention relates to apparatus for heat treating elongated sheets of metal of the type in which the sheets are transported past an elongated heating element arranged transverse to the movement of the sheet and then past internally cooled rolls.

BACKGROUND ART

British Patent Specification No. 1,537,930 discloses such an apparatus which, like the present invention, primarily is intended for anti-corrosion treatment of sheet metal made of a zirconium alloy, for example Zircaloy-4. During such heat treatment, the sheet first is heated to a temperature of at least 800° C. and then rapidly cooled in such a way that, for example, a heated sheet zone is subjected to a temperature reduction of at least 200° C. within a maximum time of 60 seconds. When using the apparatus disclosed in the previously mentioned British patent, it has been found that it is difficult to avoid, to a sufficiently great extent, oxidation of the sheet material and deformation caused by temperature stresses.

German laid-open Application No. 1,172,050 also discloses such an apparatus; however it is limited since the sheet material must be coiled when inserted and withdrawn from the apparatus. Furthermore, the uncoiling, the heat treating, and recoiling after heat treating must be carried out in an evacuated container. In order to use an apparatus similar to the one shown in the previously mentioned German application for plane sheet material, it would be necessary to increase the length of the evacuated container by at least 100%. Further, it would be necessary to open the container and pump a new vacuum for each sheet length treated.

DISCLOSURE OF INVENTION

The above-mentioned drawbacks are avoided by the use of an apparatus according to the present invention. Oxidation of the sheet material is prevented by the use of an inert protective gas while consumption of protective gas is minimized. The sheet can be heated to a temperature of at least 900° C. and rapidly cooled at an initial rate of at least 40° C./second down to 800° C. and thereafter at a cooling rate of at least 5°/second, using cooled rolls.

BRIEF DESCRIPTION OF THE DRAWINGS

The invention will be described with reference to the accompanying schematic drawings, in which:

FIG. 2 and 3 show vertical sections taken along lines II—II and III—III, respectively, of FIG. 1.

FIG. 5 shows an enlarged view of a roll pocket used in the invention.

BEST MODE FOR CARRYING OUT THE INVENTION

Figure 4:
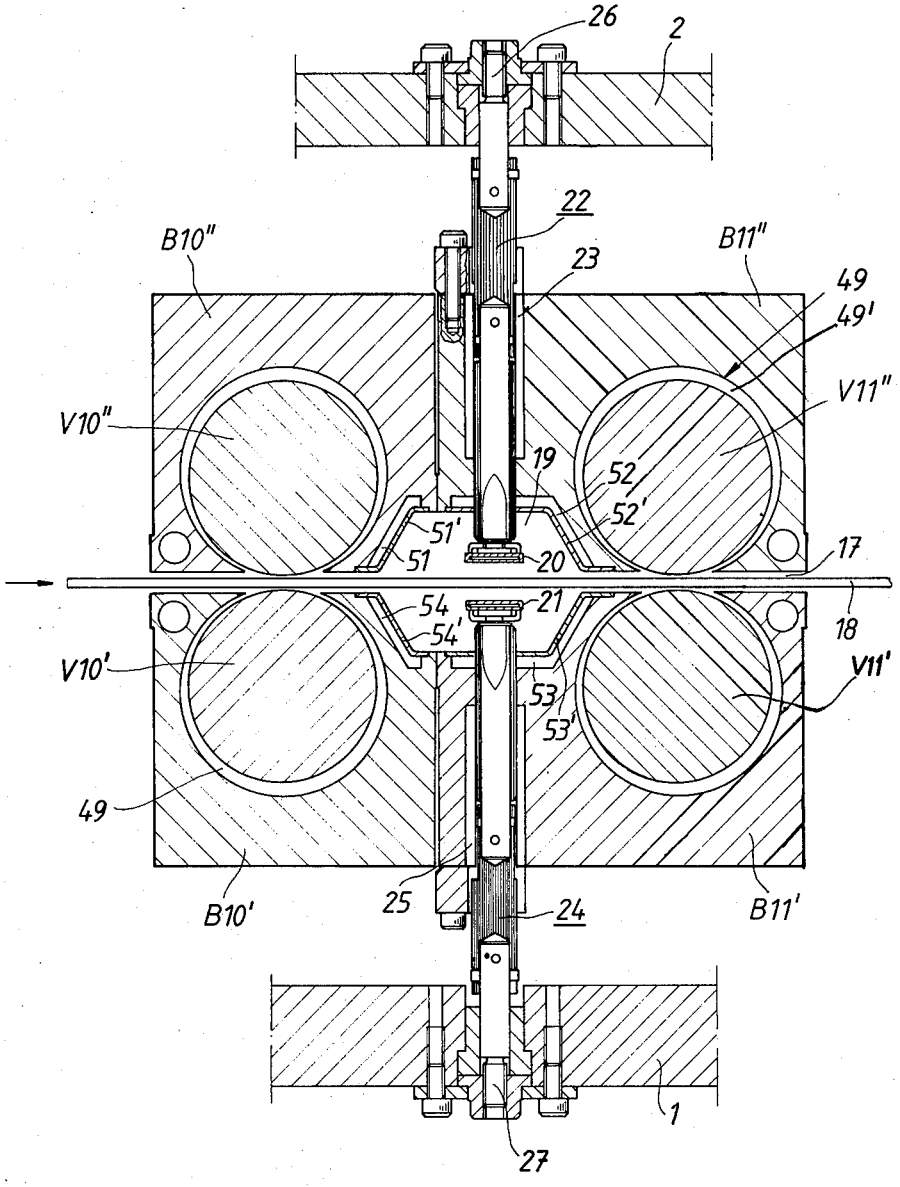
FIG. 4 shows a partial vertical section taken along the line IV—IV of FIG. 1.

The drawings illustrate one of a plurality of possible embodiments of the invention which comprises a substantially parallelepipedic housing having a bottom plate 1, a top plate 2, two side plates 3 and 4, and two end plates 5 and 6. Plates 5 and 6 are formed with horizontal gaps 7 and 8, respectively, through which sheet material is fed into and withdrawn from the apparatus, respectively. Side plates 3 and 4 each are formed with bushings or other suitable bearings for supporting twelve shaft pins belonging to six roll pairs. The shaft pins extending through side plate 3 are designated 9', 9'', 10', 10'', 11', 11'', 12', 12'', 13', 13'', 14', 14'', as shown in FIG. 3. The corresponding roll pairs are designated V9', V9''; V10', V10''; V11', V11''; and so on. In each roll a predominant portion of the roll surface, preferably at least 270° of the circumference of the roll, is surrounded by a corresponding roll-surrounding block, as shown in FIGS. 4 and 5. Roll-surrounding blocks B9', B9'' are associated with a roll pair V9', V9'' and so on, as illustrated in FIG. 4 for roll pairs V10', V10'', V11', V11'' and blocks B10', B10'', B11' and B11''. Each roll-surrounding block defines an inner circular cylindrical surface, the radius of which is somewhat greater than the radius of the surrounded roll, the surface being discontinuous along an axial gap, as shown in FIGS. 4 and 5. The surface defines a roll pocket 49 facing the strip to be heat treated. The corresponding roll is arranged in the roll pocket slightly eccentrically so that an intermediate gap 49' is formed between the roll and the roll pocket and the roll extends slightly through the axial gap in the surface of the roll pocket, as shown in FIG. 5.

Figure 2:
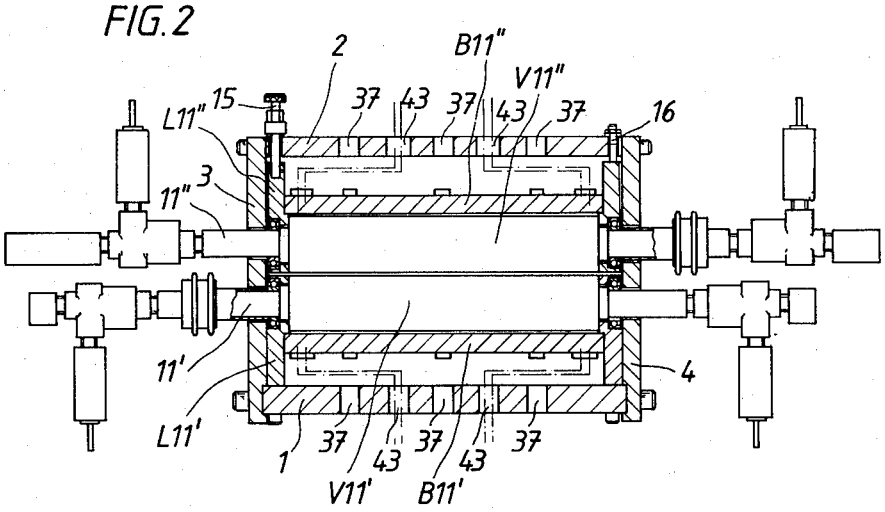

Each of the roll shaft pins extending through side plates 3 and 4 is surrounded at each side plate by a ball bearing supported by a corresponding bearing block. The bearing blocks at the side plate 4 are formed and arranged in the same way as the bearing blocks at the side plate 3 and are designated L9',L10', and so forth in a similar way as the corresponding roll shaft pins. Each bearing block is made with an annular cylindrical boss or guide means, as shown in FIG. 2, which extends into and mates snugly with the cylindrical inner surface at the corresponding end of a roll-surrounding block, thus defining the end walls of the associated roll pocket 49 and fixing each roll-surrounding block with respect to the corresponding bearing blocks. The lower bearing blocks L9', L10', and so forth, are fixed to side plates 3 and 4 of the housing. The upper bearing blocks L9'', L10'' and so forth, on the other hand, are suspended from the top plate 2 of the stand by means of individual downwardly-acting spring members which are adjustable by adjusting screws 15 and 16. The spring force is so low that no mentionable reduction in thickness of the sheet passing through the roll pairs can take place. The heat treatment apparatus shown in the drawings thus defines an elongated treatment chamber 17 extending between inlet gap 7 and outlet gap 8, the chamber 17 being traversed by a sheet 18 during the heat treatment process.

Treatment chamber 17 is bounded on its upper side by the inner and outer surfaces of the upper roll-surrounding blocks B9'', B10'', B12'', B13'', B14'' and by the corresponding bearing blocks, and on its lower side by means of the lower roll-surrounding blocks and their associated bearing blocks. The sides of treatment chamber 17 are defined partly by the bearing blocks, and partly by side plates 3 and 4. Treatment chamber 17 always is essentially sealed near its ends, since the rolls located there either are in contact with each other due to the effect of the spring members or with one side each of the sheet 18 being processed.

Figure 1:
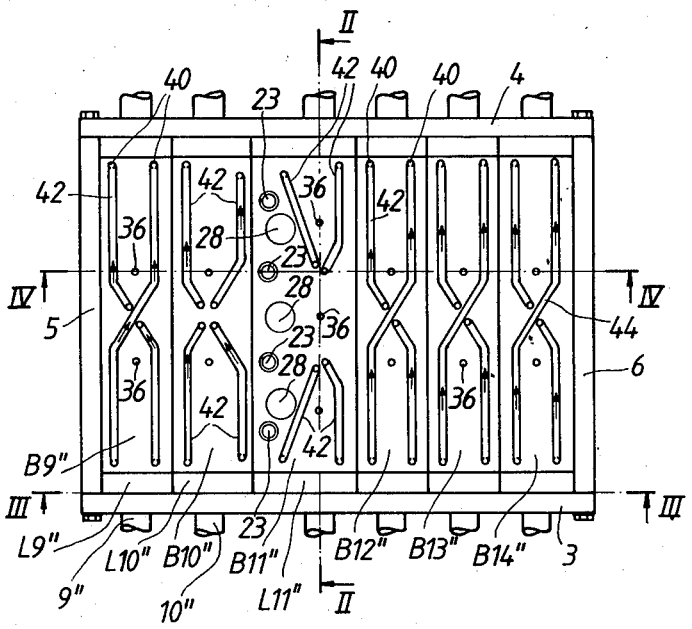
FIG. 1 shows a top view of an apparatus according to the invention, the top cover having been removed.
Figure 6:
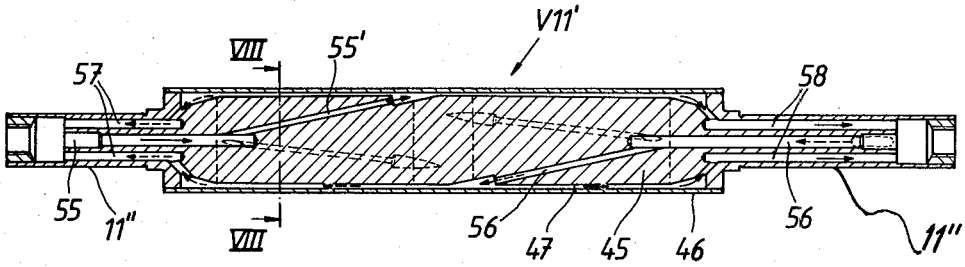
FIG. 6 shows an axial section through a roll included in the invention.
Figure 7:
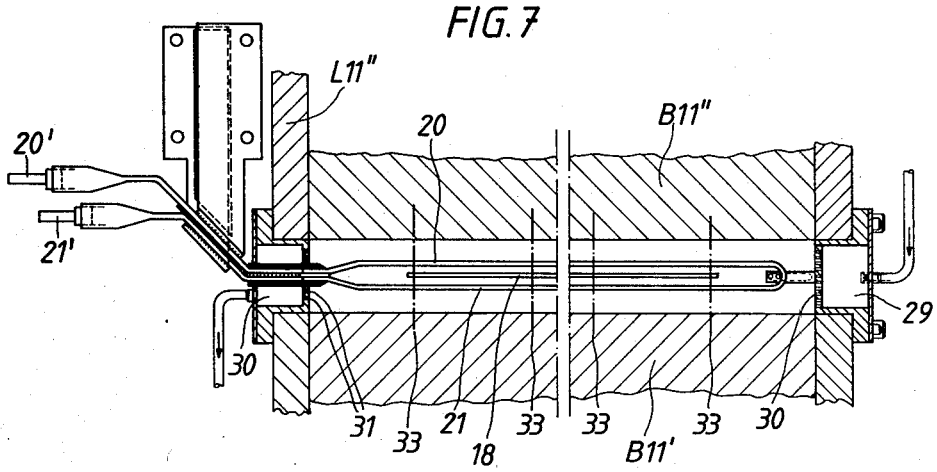
FIG. 7 shows a vertical section taken along line VII—VII of FIG. 3, illustrating a heating coil used in the invention and adapted to be connected to a high-frequency generator.

Referring now to FIGS. 6 and 7, portions of the external surfaces of blocks B10', B10'', B11' and B11'' which face chamber 17, and their corresponding bearing blocks, are recessed away from the horizontal middle plane through treatment chamber 17, to define a heating chamber 19 which extends transversely to the direction of movement of sheet 18. An open heating coil provided with directly cooled hollow conductors and adapted to be connected to a high-frequency generator, is arranged in heating chamber 19 transverse to the axis of treatment chamber 17 in such a way that sheet 18 is surrounded by the upper coil side 20 and lower coil side 21 and thus subjected to heating by induced current. A cooling fluid, for example, water, is supplied to an interior coolant conduit located within the conductor forming the coil, via an outlet tube 21'. The heating coil is fixed in a central position in heating chamber 19 by means of four upper coil supports 22. Each of coil supports 22 is electrically insulated where it passes through a hole 23 in the surrounding block B11' to be attached to the upper coil side 20. Four lower coil supports 24, also electrically insulated, are arranged opposite to upper coil supports 22 and attached to the coil side 21. Coil supports 24 similarly are passed through a corresponding hole 25 in the lower surrounding block B11'. The spacing of the ends of coil supports 22 and 24 from a central plane through treatment chamber 17 can be adjusted by means of a plurality of adjusting screws 26 and 27 arranged in the top plate 2 and in the bottom plate 3, respectively. By varying the power developed by the coil at transversely spaced locations on sheet 18 by means of the adjusting screws, an essentially uniform transverse temperature profile can be obtained in sheet 18. The four vertical dot-dash lines 33 in FIG. 7 indicate the position of the coil supports. The temperature of the sheet can be measured by means of pyrometers which are sealed within the through-holes 28 formed in the surrounding block B11'' as shown in FIG. 1. If only some of the holes 28 are provided with pyrometers, the remaining holes are plugged. Each of the holes 28 correspond to a hole in the top plate 2 (not illustrated) which is either plugged or has a gas-tight bushing for a pyrometer.

Heating chamber 19 communicates at side wall 3 with an inlet chamber 29 for a protective gas, such as argon, and at side wall 4 with an outlet chamber 30. A plurality of inlet openings 31 in inlet chamber 29 lead to heating chamber 19; and a plurality of outlet openings 32 in heating chamber 19 lead to outlet chamber 30. The total area of inlet openings 31 is chosen to be considerably greater than that of outlet openings 32. After the air has been exhausted from treatment chamber 17 and heating chamber 19 through chamber 30 by means not shown, chamber 30 can suitably be used as an inlet chamber for protective gas in addition to inlet chamber 29, whereby the gas consumption becomes relatively small.

The heating chamber 19 is cooled by means of four cooling channels 51, 52, 53, and 54 shown in FIG. 4, which are provided in the adjacent roll-surrounding blocks and arranged to be traversed by cooling water in the longitudinal direction of the heating chamber. These cooling channels may be made by forming a corresponding slot, running parallel to the longitudinal direction of the rolls and facing outwardly towards the heating chamber, in each of the adjacent roll-surrounding blocks, and by sealing these slots by means of copper plates 51', 52', 53', 54', each of which is mounted to a corresponding roll-surrounding block and secured by means of hard soldering.

As shown in FIG. 5, the roll-surrounding blocks each are provided on the inside surface of roll pocket 49 with preferably more than six transversely spaced inlet openings 34 for protective gas. These openings extend from an elongated distribution header or channel 35 which, in turn, communicates with a number of supply openings 36 for protective gas. Each opening 36 is connected to a gas delivery tube, each of which passes through an appropriate seal fitting provided in respective openings 37 in top and bottom plates 2 and 1. Each of the roll-surrounding blocks B11' and B11'' is provided with two laterally spaced substantially annular seals (not shown) whereby the space between the blocks and the roll is divided into three partial spaces positioned axially one after the other along the roll. These are individually supplied with protective gas through individual inlet openings 36 and individual distributing channels. The cooling effect of the protective gas on the sheet 18 can then be varied along the length of the roll.

Each roll-surrounding block is provided with two cooling channels 38 and 39 running in the longitudinal direction of the block as shown in FIG. 5. These cooling channels are connected at the ends to substantially vertically running inlet channels 40 and outlet channels 41 for cooling water, which channels are connected to supply tubes. The channels 40 and 41 are connected either to water inlet/outlet tubes 42 which pass in a sealing manner through openings 43 in the top plate 2 or the bottom plate 1; or to water tubes 44 for series connection of the two cooling channels 38 and 39 in a roll-surrounding block. See FIG. 1.

Figure 8:
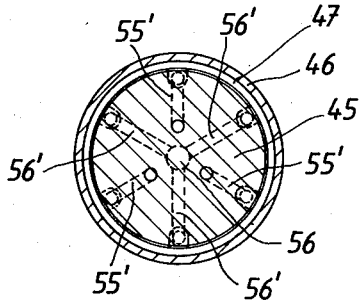
FIG. 8 shows a section through the roll taken along line VIII—VIII of FIG. 6.

In a device according to the invention the rolls are cooled internally by water or some other fluid in at least one pair of rolls, namely that which is located nearest the heating coil in the direction of movement of sheet 18. Preferably several pairs of rolls are water-cooled. In the embodiment shown in the drawing all pairs of rolls are water-cooled, except that which is nearest to the inlet gap 7. The water-cooled rolls are constructed as shown in FIG. 7 and FIG. 8, at least with regard to the roll pair which is nearest the heating coil in the direction of movement of sheet 18.

The roll comprises a substantially cylindrical core 45, at the ends of which there is welded a hollow-cylindrical body 46 in such a way that a hollow-cylindrical cooling water space 47 is formed between the core 45 and the hollow-cylindrical body. The core 45 is formed with two shaft pins 11'' and 11''', each of which is formed with an inlet channel for cooling water, 55 and 56, respectively. In addition to this, each shaft pin has two outlet channels 57 and 58, respectively. The outlet channels of the left shaft pin are included together with the inlet channel of the right shaft pin in a closed cooling water circuit, and inversely. Thus, the roll has two different cooling circuits. The directions of through-flow are indicated in the drawing by unbroken arrows for one cooling circuit and by broken arrows for the second circuit. Each of the inlet channels 55 and 56 is divided into three branches 55' and 56', respectively, which, at the central portion of the roll, open out into the hollow-cylindrical cooling water space 47. One cooling circuit cools substantially only the right-hand roll half. By varying the ratio between the water flows of the two circuits, it is then possible to vary the cooling effect of the roll along the width of the sheet in a suitable manner, thereby avoiding deformation of the treated metal sheet as a consequence of the sudden cooling. The rolls are chain-driven and provided with a common driving motor.

INDUSTRIAL APPLICABILITY

The invention finds particular application in the heat-treating of sheet materials such as metal alloys of zirconium. Although inert gas atmosphere is provided during heat treatment of such alloys, other applications are possible in which specially reactive gases are applied during heat treatment or at other times in the process, to provide desired characteristics in the end product. Other sheet materials also may be treated.

What is claimed is:

1. Apparatus for heat treatment of an elongated sheet comprising:

at least one elongated heating element;

at least one pair of internally cooled rolls, positioned after said heating element in the direction of movement of an elongated sheet, for transporting a sheet past said heating element in a direction transverse to the axis of both the rolls and said heating element;

a treatment chamber having walls facing and substantially enclosing said heating element and that portion of the sheet between said heating element and said pair of rolls, said chamber having inlet and outlet gaps for the sheet as it is transported through the apparatus;

means for passing an oxidation-preventive protective gas through said treatment chamber; and at least one pair of substantially enclosed roll pockets housing said cooled rolls, said pockets communicating with said treatment chamber, whereby the surfaces of said pockets define a further extended portion of said treatment chamber.

2. Apparatus according to claim 1, wherein said heating element comprises a coil which is adapted to be operatively connected to an electric current source comprising a high frequency generator, whereby heating current may be induced in the sheet as it moves past said coil.

3. Apparatus according to claim 1, wherein there are several pairs of rolls arranged one after the other in the direction of movement of the sheet with one roll of each pair on each side of the sheet, each roll being mounted within a respective roll-surrounding block supported at each end by respective bearing blocks arranged in contact with said roll-surrounding blocks.

4. Apparatus according to claim 3, wherein each roll-surrounding block is provided with at least one channel for passing said protective gas into a space defined between said roll-surrounding block and its respective roll.

5. Apparatus according to claim 3, wherein said treatment chamber is defined by downwardly-facing surfaces in at least one of said roll-surrounding blocks located above the elongated sheet and upwardly-facing surfaces in another of said roll-surrounding blocks located below the elongated sheet.

6. Apparatus according to claim 5, wherein a predominant portion of said upwardly-and downwardly-facing surfaces comprises at least one heat conductive sheet element defining at least one coolant channel between said sheet element and the respective roll-surrounding blocks.

7. Apparatus according to claim 2, wherein said heating coil is configured to surround a portion of the elongated sheet, further comprising at least two means for suspending said coil within said treatment chamber, said suspending means being spaced axially along said coil and comprising upper and lower coil supports attached to opposite coils sides; and means for adjusting the distance between said coil supports whereby said induced heating current may be varied.

8. Apparatus according to claim 1, further comprising means for independently cooling first and second axially spaced portions of said cooled rolls, to minimize thermal distortion of the sheet.

* * * * *